US011607592B2

(12) United States Patent
Friedman

(10) Patent No.: US 11,607,592 B2
(45) Date of Patent: Mar. 21, 2023

(54) WEIGHT ADJUSTABLE THROWING JAVELIN

(71) Applicant: Erick Conrad Friedman, Union City, PA (US)

(72) Inventor: Erick Conrad Friedman, Union City, PA (US)

( * ) Notice: Subject to any disclaimer, the term of this patent is extended or adjusted under 35 U.S.C. 154(b) by 286 days.

(21) Appl. No.: 16/829,701

(22) Filed: Mar. 25, 2020

(65) Prior Publication Data

US 2020/0306605 A1 Oct. 1, 2020

Related U.S. Application Data

(60) Provisional application No. 62/823,313, filed on Mar. 25, 2019.

(51) Int. Cl.
*A63B 65/02* (2006.01)

(52) U.S. Cl.
CPC ..... *A63B 65/02* (2013.01); *A63B 2225/09* (2013.01)

(58) Field of Classification Search
CPC ..... A63B 21/00; A63B 21/0004; A63B 21/06; A63B 21/0608; A63B 21/0609; A63B 21/0615; A63B 21/0616; A63B 21/0617; A63B 21/0618; A63B 21/065; A63B 21/068; A63B 21/4047; A63B 21/4049; A63B 21/00058; A63B 21/00061; A63B 21/4023; A63B 21/4043; A63B 22/00; A63B 22/0002; A63B 22/0005; A63B 22/0007; A63B 22/001; A63B 22/0012; A63B 22/0015; A63B 22/0017; A63B 22/0025; A63B 2023/003; A63B 2023/006; A63B 23/00; A63B 23/035; A63B 23/03508; A63B 23/03516; A63B 23/12; A63B 23/1209; A63B 23/1245; A63B 23/1281; A63B 23/14; A63B 23/16; A63B 24/00; A63B 65/00; A63B 65/02;

(Continued)

(56) References Cited

U.S. PATENT DOCUMENTS 1,552,442 A * 9/1925 Lund ..... A63B 65/02 473/44
1,569,395 A * 1/1926 Reach ..... A63B 65/02 482/20

(Continued)

OTHER PUBLICATIONS

STIC search (Year: 2022).*

*Primary Examiner* — Megan Anderson
*Assistant Examiner* — Thao N Do
(74) *Attorney, Agent, or Firm* — Dunlap Bennett & Ludwig, PLLC

(57) ABSTRACT

A weight adjustable javelin includes an elongated shaft having a leading end and a trailing end. A nose piece includes a conical shape, a nose tip, a nose base, and an internal nose slot defined along a longitudinal axis of the nose piece. The nose base includes an opening leading into the internal nose slot. A tail piece includes a tail tip, a tail base, and an internal tail slot defined along a longitudinal axis of the tail piece. The tail base includes an opening leading into the internal tail slot. The nose base is releasably secured to the leading end of the elongated shaft. The tail base is releasably secured to the trailing end of the elongated shaft. The internal nose slot and the internal tail slot are configured to receive and retain different sized and weighted rods therein.

10 Claims, 4 Drawing Sheets

(58) Field of Classification Search
CPC ..... A63B 65/04; A63B 65/06; A63B 65/08; A63B 65/10; A63B 65/12; A63B 65/122; A63B 65/125; A63B 65/127; A63B 2230/00; A63B 2230/01; A63B 2244/15; A63B 2244/16; A63B 2244/17; A63B 15/00; A63B 15/005
USPC ..... 482/20; 446/120–121, 124, 127, 473
See application file for complete search history.

(56) References Cited

U.S. PATENT DOCUMENTS 1,731,686 A * 10/1929 Rinneberg ..... A63B 65/02 482/20
1,994,089 A * 3/1935 Pipal ..... A63B 65/02 482/20
2,044,092 A * 6/1936 Manzeck ..... A63B 65/02 473/48
2,122,023 A * 6/1938 Campbell ..... A63B 65/02 473/49
2,196,610 A * 4/1940 Schlademan ..... A63B 65/02 482/20
2,213,637 A * 9/1940 Osgood ..... F42B 6/00 473/585
2,940,758 A * 6/1960 Richter ..... A01B 1/22 473/584
2,976,042 A * 3/1961 Barnett ..... F42B 6/003 473/586
3,216,727 A * 11/1965 Hunter ..... A63B 67/00 273/350
3,232,613 A 2/1966 Laube, Jr.
3,344,711 A 10/1967 Mawhinney et al.
3,746,334 A * 7/1973 Stubblefield ..... A63B 65/02 473/585
3,820,787 A * 6/1974 Heinbigner ..... A63B 63/00 473/439
4,021,041 A * 5/1977 Goldfarb ..... A63B 65/00 473/585
4,333,643 A * 6/1982 Saffire ..... A63B 65/02 482/20
4,381,866 A * 5/1983 Simo ..... F42B 6/08 30/337
4,404,053 A * 9/1983 Saffire ..... B29C 70/08 428/377
4,429,480 A * 2/1984 Stude ..... A01K 81/00 43/6
4,457,514 A * 7/1984 Paxman ..... F42B 6/003 473/585
4,729,320 A * 3/1988 Whitten, III ..... F42B 12/362 473/577
5,009,433 A * 4/1991 Reid ..... F42B 6/003 473/582
5,127,890 A * 7/1992 Noren ..... A63B 65/02 482/20
5,145,187 A * 9/1992 Lewis ..... F42B 6/08 473/584
D373,611 S * 9/1996 Thompson ..... D22/118
5,628,713 A * 5/1997 Wilkinson ..... A63B 21/072 482/93
5,820,473 A 10/1998 Lambros
D435,612 S * 12/2000 Petranoff ..... D21/707
6,585,623 B1 * 7/2003 Hilmer-Gabcke ..... A63B 65/02 482/148
6,893,367 B1 * 5/2005 Nudo ..... A63B 67/14 473/588
7,044,858 B1 5/2006 Otto et al.
7,331,886 B2 2/2008 Morris et al.
7,344,457 B2 * 3/2008 Liberatore ..... A63B 69/3638 473/422
7,713,151 B2 * 5/2010 Fulton ..... F42B 6/08 473/583
7,871,344 B1 * 1/2011 Massman ..... F42B 6/003 473/578
9,517,377 B2 * 12/2016 Villella ..... A63B 21/0724
9,772,169 B2 9/2017 Greenwood
10,500,476 B2 12/2019 Farr
2002/0136847 A1 * 9/2002 Held ..... A63B 65/02 264/165
2004/0092332 A1 * 5/2004 Willett ..... A63B 53/0466 473/338
2006/0100075 A1 * 5/2006 Harsh ..... A63B 23/0405 482/142
2006/0105891 A1 * 5/2006 Cappellini ..... A63B 21/0726 482/106
2007/0060406 A1 3/2007 Miki
2007/0082767 A1 * 4/2007 Smith ..... F42B 6/08 473/582
2007/0135275 A1 * 6/2007 Oates ..... A63B 21/0004 482/109
2008/0171643 A1 * 7/2008 Baudhuin ..... A63B 21/156 482/148
2010/0248867 A1 * 9/2010 Tande ..... A63B 15/005 473/457
2011/0028238 A1 * 2/2011 Boyd ..... A63B 53/0466 473/345
2014/0100066 A1 * 4/2014 Roman ..... F42B 12/362 473/582
2015/0087479 A1 3/2015 Terauds
2015/0141180 A1 * 5/2015 Connolly ..... F42B 6/04 473/578
2015/0335962 A1 * 11/2015 Brady ..... A63B 53/02 473/299
2016/0076862 A1 * 3/2016 Connolly ..... B29C 70/56 473/578
2017/0234706 A1 * 8/2017 Martin ..... A63C 11/00 29/407.05
2018/0003471 A1 * 1/2018 Greenwood ..... F42B 6/04
2018/0242564 A1 * 8/2018 DeBauch ..... F16B 7/182
2019/0192940 A1 * 6/2019 Wharton ..... A63B 69/20
2019/0240544 A1 * 8/2019 Towell ..... A63B 53/02
2020/0306605 A1 * 10/2020 Friedman ..... A63B 65/02

* cited by examiner

WEIGHT ADJUSTABLE THROWING JAVELIN

CROSS-REFERENCE TO RELATED APPLICATION

This application claims the benefit of priority of U.S. provisional application No. 62/823,313, filed Mar. 25, 2019, the contents of which are herein incorporated by reference.

BACKGROUND OF THE INVENTION

The present invention relates to throwing javelins and, more particularly, to a weight adjustable throwing javelin.

A javelin is a light spear designed primarily to be thrown, historically as a ranged weapon, but today predominantly for sport. The javelin is almost always thrown by hand. Current javelins are manufactured at specified weights. The weight and the center of balance of the javelin cannot be adjusted.

As can be seen, there is a need for a weight adjustable throwing javelin.

SUMMARY OF THE INVENTION

In one aspect of the present invention, a weight adjustable javelin comprises: an elongated shaft comprising a leading end and a trailing end; a nose piece having a conical shape and comprising a nose tip, a nose base, and an internal nose slot defined along a longitudinal axis of the nose piece, wherein the nose base comprises an opening leading into the internal nose slot; and a tail piece having a tail tip, a tail base, and an internal tail slot defined along a longitudinal axis of the tail piece, wherein the tail base comprises an opening leading into the internal tail slot, wherein the nose base is releasably secured to the leading end of the elongated shaft, the tail base is releasably secured to the trailing end of the elongated shaft; and the internal nose slot and the internal tail slot are configured to receive and retain different sized rods therein.

In another aspect of the present invention, a method of adjusting a weight of a throwing javelin comprises: providing the throwing javelin comprising: an elongated shaft comprising a leading end and a trailing end; a nose piece comprising a nose tip, a nose base, and an internal nose slot defined along a longitudinal axis of the nose piece, wherein the nose base comprises an opening leading into the internal nose slot; and a tail piece having a tail tip, a tail base, and an internal tail slot defined along a longitudinal axis of the tail piece, wherein the tail base comprises an opening leading into the internal tail slot, wherein the nose base is releasably secured to the leading end of the elongated shaft, the tail base is releasably secured to the trailing end of the elongated shaft; removing the nose piece from the leading end of the elongated shaft and the tail piece from the trailing end of the elongated shaft; inserting a first rod into the internal nose slot and a second rod into the internal tail slot; and reattaching the nose piece to the leading end of the elongated shaft and the tail piece to the trailing end of the elongated shaft.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a throwing javelin with nose and tail pieces used to obtain weight and balance. The present invention allows weights to be added and fixed to the part to obtain balance or to change the weight of the javelin. The weight can be added to the nose or tail by inserting rods into the part so the weight cannot come loose. The present invention allows a method of obtaining perfect balance by distributing the weight to the front, back, or both.

The nose and tail pieces of the javelin are affixed to a hollow shaft which creates a throwing implement. This implement meets certain criteria such as total weight, and a defined area that is the center of balance of the implement. Weight can be added to the nose, tail, or both to meet the overall weight and center of balance requirements. The nose and tail pieces allow weights to be fixed to those pieces. The present invention also allows the flexibility to change weight and balance for possible future requirements and new products.

Figure 1:
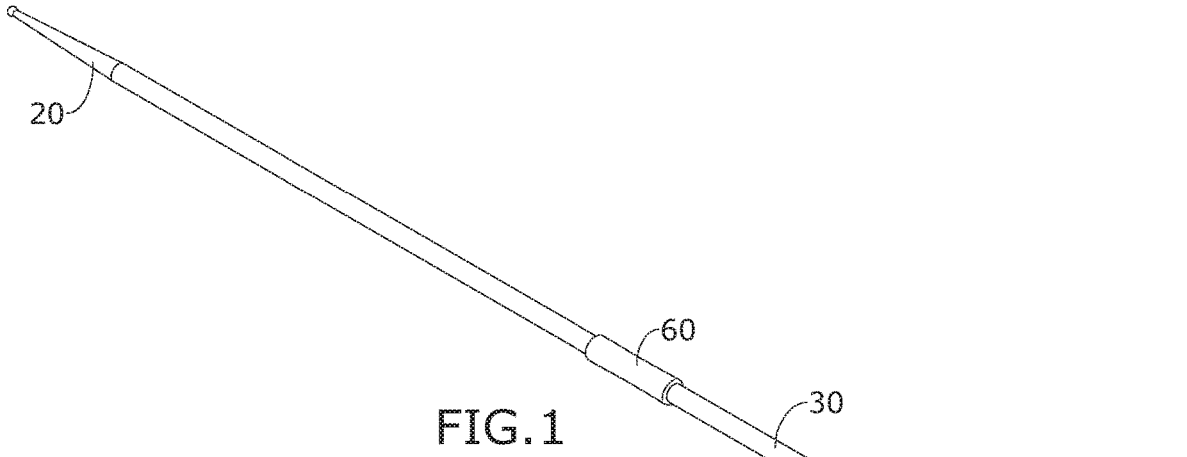
FIG. 1 is a perspective view of an embodiment of the present invention.
Figure 2:
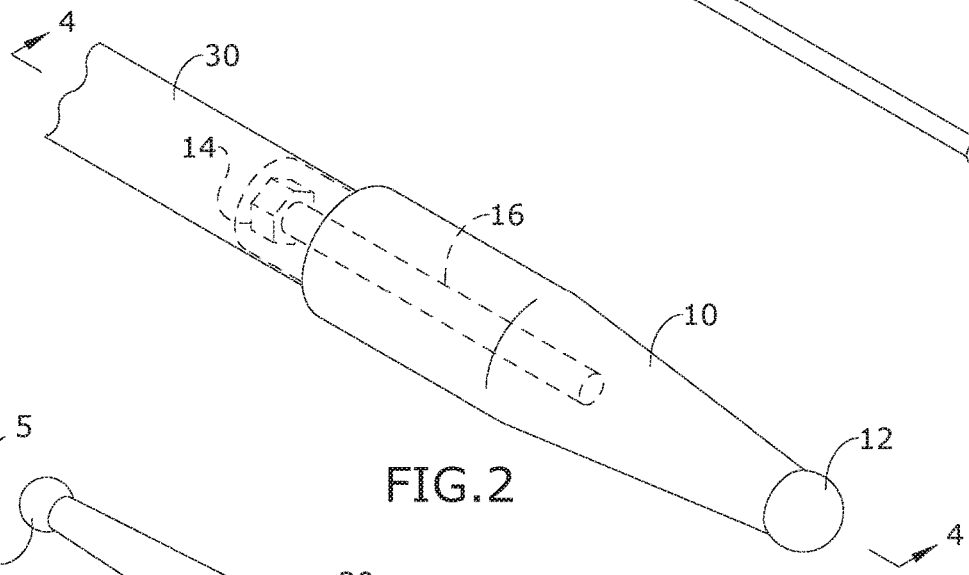
FIG. 2 is a detail perspective view of a nose piece of an embodiment of the present invention.
Figure 3:
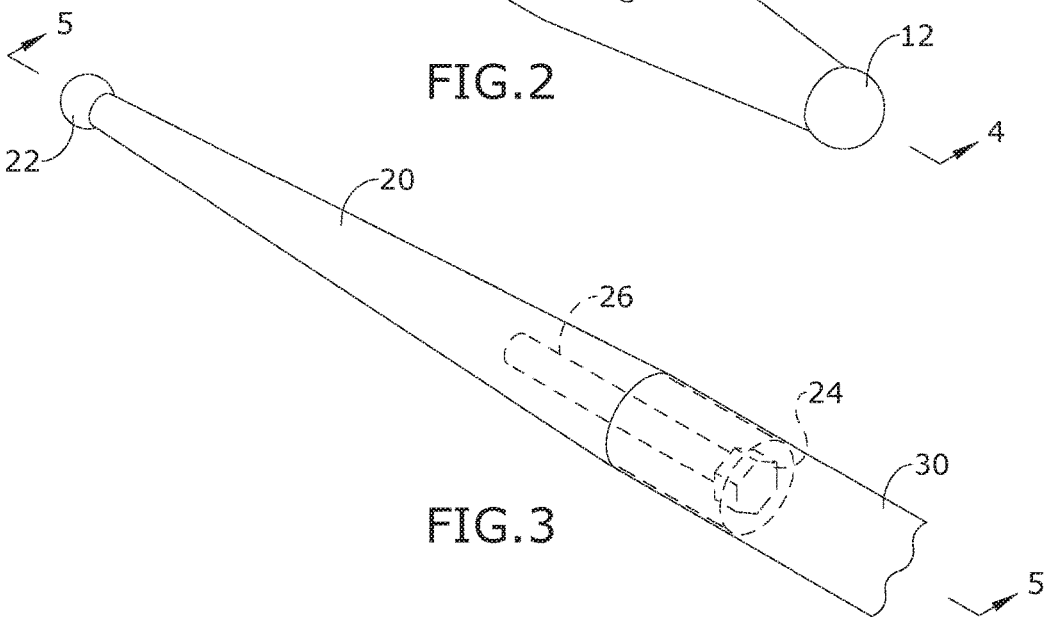
FIG. 3 is a detail perspective view of a tail piece of an embodiment of the present invention.
Figure 4:
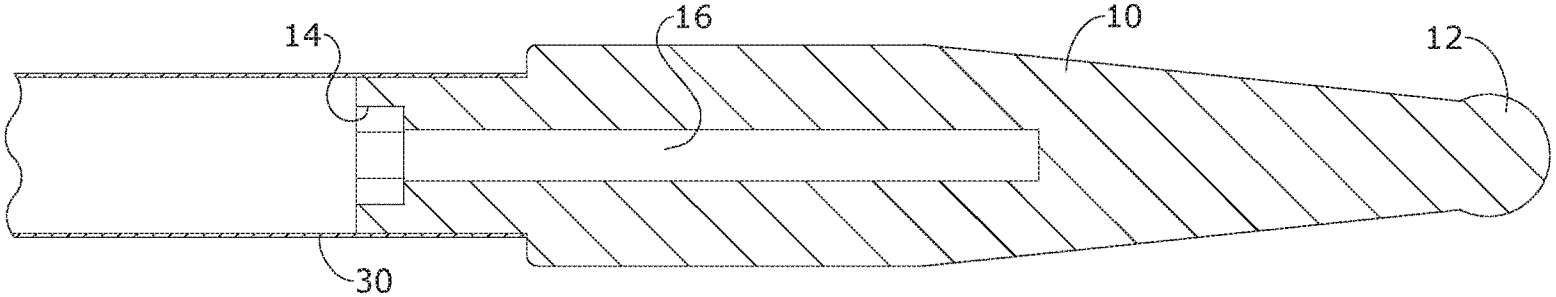
FIG. 4 is a section view of the present invention taken along line 4-4 of FIG. 2.
Figure 5:
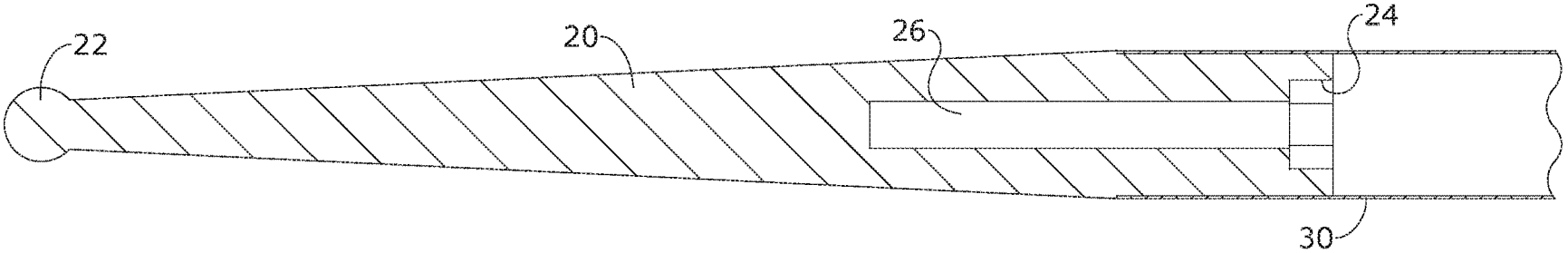
FIG. 5 is a section view of the present invention taken along line 5-5 of FIG. 3.
Figure 6:
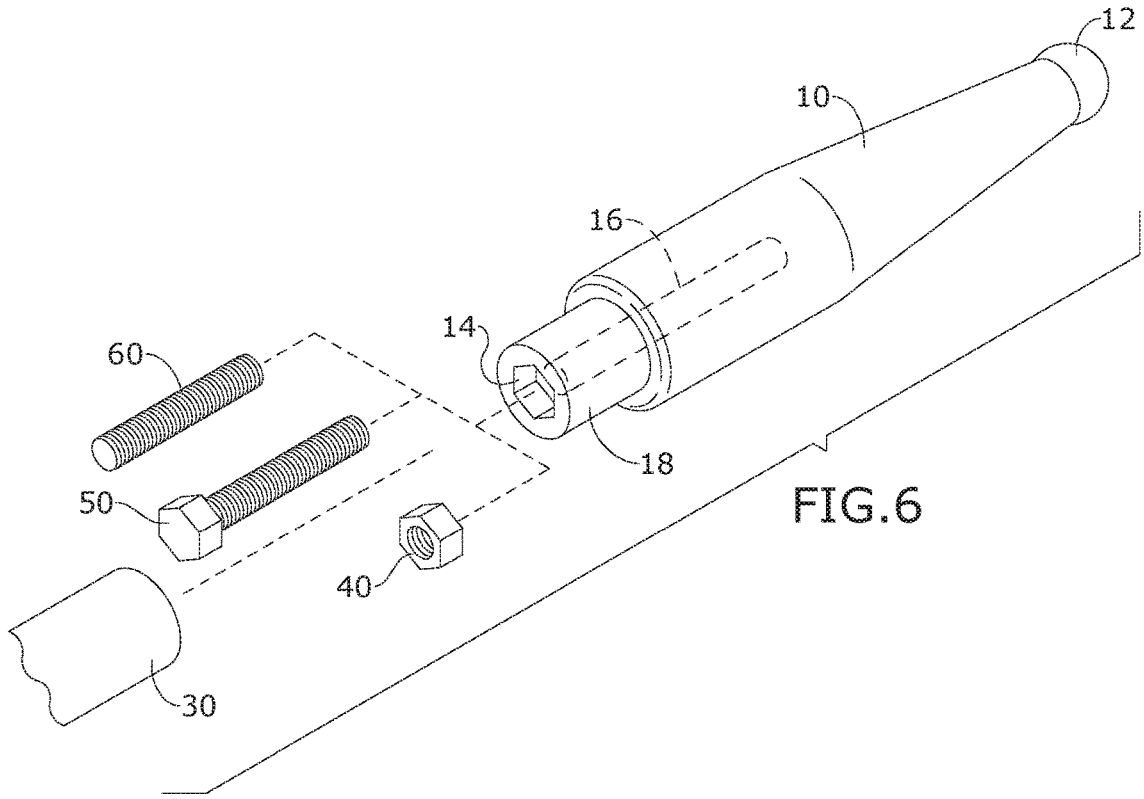
FIG. 6 is an exploded view of an embodiment of the present invention.
Figure 7:
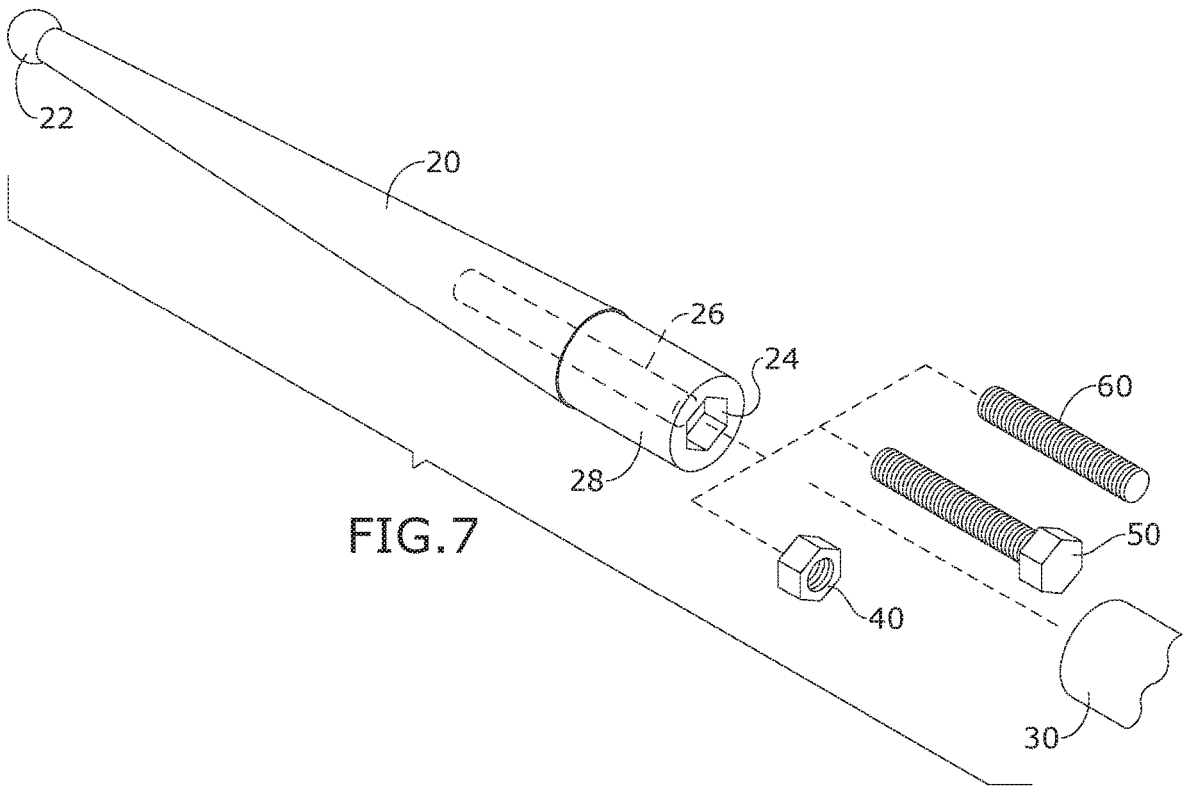
FIG. 7 is an exploded view of an embodiment of the present invention.
Figure 8:
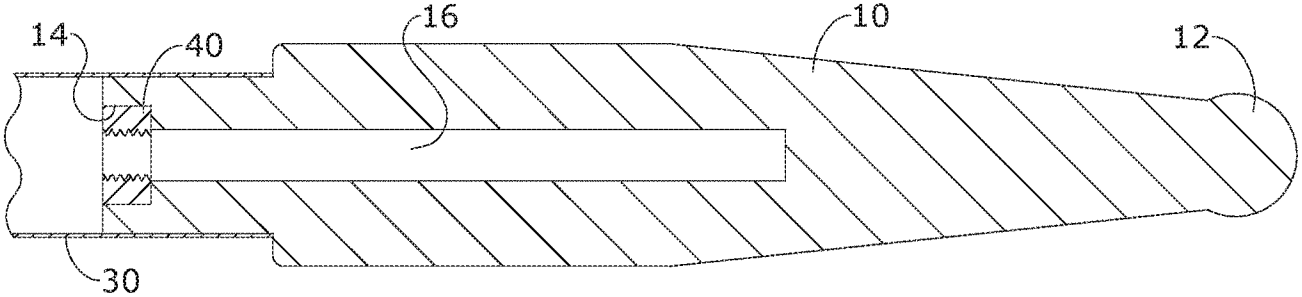
FIG. 8 is a section view of an embodiment of the present invention.
Figure 9:
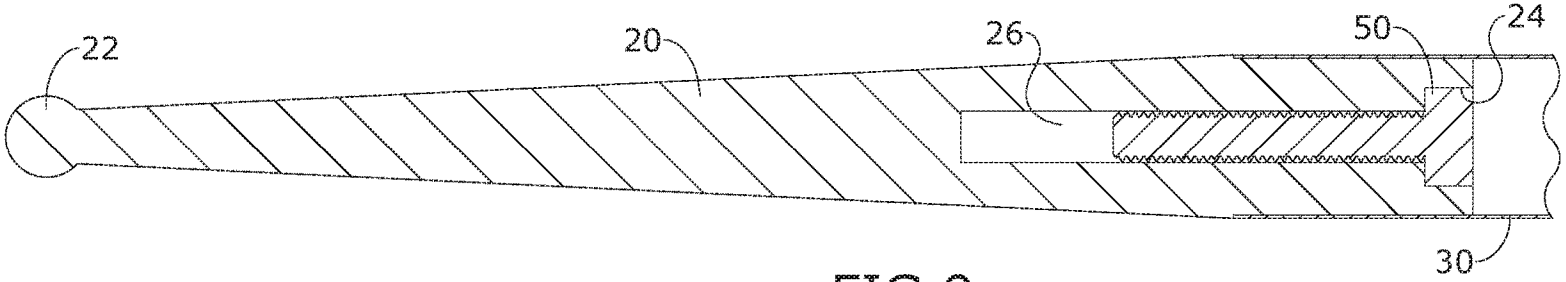
FIG. 9 is a section view of an embodiment of the present invention.
Figure 10:
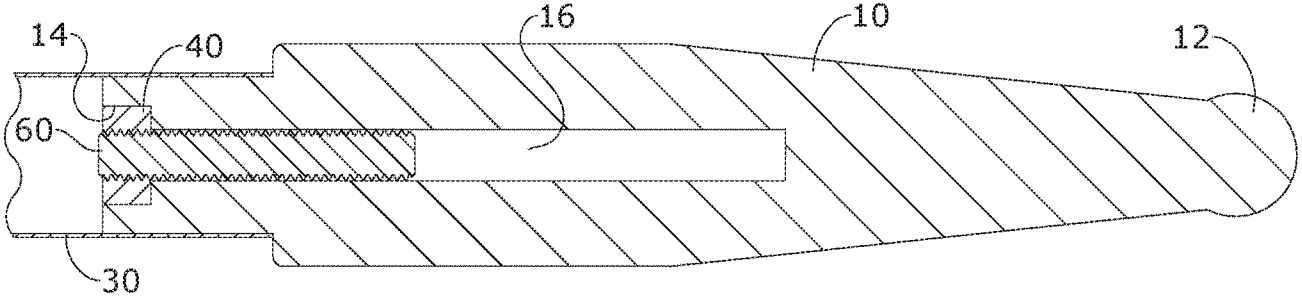
FIG. 10 is a section view of an embodiment of the present invention.

Referring to FIGS. 1 through 10, the present invention may include a weight adjustable javelin. The weight adjustable javelin includes an elongated shaft 30 having a leading end and a trailing end. A nose piece 10 includes a conical shape, a nose tip 12, a nose base 18, and an internal nose slot 16 defined along a longitudinal axis of the nose piece 10. The nose base 18 includes an opening leading into the internal nose slot 16. A tail piece 20 includes a tail tip 22, a tail base 28, and an internal tail slot 26 defined along a longitudinal axis of the tail piece 20. The tail base 28 includes an opening leading into the internal tail slot 26. The nose base 18 is releasably secured to the leading end of the elongated shaft 30. The tail base 28 is releasably secured to the trailing end of the elongated shaft 30. The internal nose slot 16 and the internal tail slot 26 are configured to receive and retain different sized and weighted rods 50, 60 therein.

The nose piece 10 and the tail piece 20 may each be made of a flexible and resilient material, such as but not limited to, rubber, silicon, plastics, or other polymers. Additionally, the internal nose slot 16 and the internal tail slot 26 may be smooth bored or threaded. Due to the flexible and resilient material, different sized and weighted rods 50, 60 may be screwed or urged into the internal nose slot 16 and the internal tail slot 26, which adjusts the weight of the nose piece 10 and the tail piece 20 respectively, as well as the center of balance. In certain embodiments, the nose tip is rounded. In certain embodiments, the tail piece 20 also includes a conical shape with a rounded tail tip.

The elongated rod 30 may be made of metal, rubber, plastics, composites, or the like. In certain embodiments, the elongated rod 30 includes a hollow center and a grip 62 disposed about a central portion. The leading end and the trailing end are each open ended. In such embodiments, the nose base 18 and the tail base 28 may each include cylindrical posts that friction fit within the open ends of the leading end and the trailing end respectively.

As mentioned above, the different sized rods 50, 60 are configured to friction fit within the internal nose slot 16 and the internal tail slot 26. The rods 50, 60 may include threaded rods 50, bolts 60, or other elongated weighted metal pieces. In certain embodiments, the internal nose slot 16 includes a head portion 14 defining the opening at the head base 18 and the internal tail slot 26 includes a head portion 24 defining the opening at the tail base 28. Each of the head portions 14, 24 include a larger bore size than a remainder of the respective slots 16, 26 so that a threaded nut 40 may fit therein.

A method of adjusting a weight of a throwing javelin may include the following steps: provide the throwing javelin described above; remove the nose piece from the leading end of the elongated shaft and the tail piece from the trailing end of the elongated shaft; insert a first rod into the internal nose slot and a second rod into the internal tail slot; and reattach the nose piece to the leading end of the elongated shaft and the tail piece to the trailing end of the elongated shaft.

The present invention is used to assemble a throwing implement. The present invention allows the total weight and balance of the implement to be changed or altered if needed.

It should be understood, of course, that the foregoing relates to exemplary embodiments of the invention and that modifications may be made without departing from the spirit and scope of the invention as set forth in the following claims.

What is claimed is:

1. A weight adjustable javelin comprising:

an elongated shaft comprising a leading end and a trailing end;

a nose piece having a conical shape and comprising a nose tip, a nose base, and an internal nose slot defined along a longitudinal axis of the nose piece, wherein the nose base comprises an opening leading into the internal nose slot; and a tail piece having a tail tip, a tail base, and an internal tail slot defined along a longitudinal axis of the tail piece, wherein the tail base comprises an opening leading into the internal tail slot, wherein the nose base is releasably secured to the leading end of the elongated shaft, the tail base is releasably secured to the trailing end of the elongated shaft, the internal nose slot is configured to receive and retain a first weighted rod, the internal tail slot is configured to receive and retain a second weighted rod, and the leading end and the trailing end are each open ends, wherein the nose base friction fits within the open end of the leading end and the tail base friction fits within the open end of the trailing end.

2. The weight adjustable javelin of claim 1, wherein the nose piece and the tail piece are each made of a flexible and resilient material.

3. The weight adjustable javelin of claim 2, wherein the internal nose slot and the internal tail slot are configured to friction fit, the first weighted rod and the second weighted rod, respectively.

4. The weight adjustable javelin of claim 1, wherein the tail piece has a conical shape.

5. The weight adjustable javelin of claim 4, wherein the tail tip is rounded.

6. The weight adjustable javelin of claim 1, wherein the internal nose slot and the internal tail slot each comprise a head portion comprising a larger bore size than a remainder of the internal nose slot and the internal tail slot, respectively.

7. The weight adjustable javelin of claim 1, wherein the nose tip is rounded.

8. A method of adjusting a weight of a throwing javelin comprising:

providing the throwing javelin comprising:

an elongated shaft comprising a leading end and a trailing end;

a nose piece comprising a nose tip, a nose base, and an internal nose slot defined along a longitudinal axis of the nose piece, wherein the nose base comprises an opening leading into the internal nose slot; and a tail piece having a tail tip, a tail base, and an internal tail slot defined along a longitudinal axis of the tail piece, wherein the tail base comprises an opening leading into the internal tail slot, wherein the nose base is releasably secured to the leading end of the elongated shaft, the tail base is releasably secured to the trailing end of the elongated shaft;

removing the nose piece from the leading end of the elongated shaft and the tail piece from the trailing end of the elongated shaft;

inserting a first rod into the internal nose slot or a second rod into the internal tail slot; and reattaching the nose piece to the leading end of the elongated shaft and the tail piece to the trailing end of the elongated shaft, wherein the first weighted rod and the second weighted rod have different weights.

9. The method of claim 8, wherein the nose piece and the tail piece are each made of a flexible and resilient material.

10. The weight adjustable javelin of claim 1, further comprising at least one of the first weighted rod and the second weighted rod.

* * * * *